United States Patent [19]

Dills et al.

[11] Patent Number: 4,458,126

[45] Date of Patent: Jul. 3, 1984

[54] MICROWAVE OVEN WITH DUAL FEED EXCITATION SYSTEM

[75] Inventors: Raymond L. Dills, Louisville, Ky.; Royce W. Hunt, Jeffersonville, Ind; Louis H. Fitzmayer, Louisville, Ky.

[73] Assignee: General Electric Company, Louisville, Ky.

[21] Appl. No.: 363,705

[22] Filed: Mar. 30, 1982

[51] Int. Cl.[3] ..... H05B 6/72

[52] U.S. Cl. ..... 219/10.55 F

[58] Field of Search ..... 219/10.55 F, 10.55 A, 219/10.55 R, 10.55 M

[56] References Cited

U.S. PATENT DOCUMENTS

| | | | |
|---|---|---|---|
| 2,704,802 | 3/1955 | Blass et al. | 219/10.55 |
| 2,961,520 | 11/1960 | Long | 219/10.55 |
| 3,210,511 | 10/1965 | Smith | 219/10.55 |
| 3,263,052 | 7/1966 | Jeppson et al. | 219/10.55 |
| 3,373,259 | 3/1968 | Smith | 219/10.55 |
| 3,446,929 | 5/1969 | Smith | 219/10.55 |
| 3,467,803 | 9/1969 | Ojelid | 219/10.55 |
| 3,492,454 | 1/1970 | Smith | 219/10.55 |
| 3,549,849 | 12/1970 | Boehm | 219/10.55 |
| 3,619,536 | 11/1971 | Boehm | 219/10.55 |
| 3,705,283 | 12/1972 | Sayer, Jr. | 219/10.55 |
| 3,798,404 | 3/1974 | Simon et al. | 219/10.55 |
| 3,810,248 | 5/1974 | Risman et al. | 219/10.55 |
| 3,823,295 | 7/1974 | Simon et al. | 219/10.55 |
| 3,851,133 | 11/1974 | Dygve et al. | 219/10.55 |
| 4,019,009 | 4/1977 | Kusunoki et al. | 219/10.55 F |
| 4,028,520 | 6/1977 | Torrey | 219/10.55 B |
| 4,028,521 | 6/1977 | Uyeda et al. | 219/10.55 F |
| 4,121,078 | 10/1978 | Takano et al. | 219/10.55 F |
| 4,133,997 | 1/1979 | Thuleen | 219/10.55 F |
| 4,140,888 | 2/1979 | Baron et al. | 219/10.55 F |
| 4,159,406 | 6/1979 | Tate et al. | 219/10.55 F |
| 4,160,145 | 7/1979 | Rueggeberg | 219/10.55 F |
| 4,162,380 | 1/1979 | Burke | 219/10.55 F |
| 4,165,454 | 8/1979 | Carlsson et al. | 219/10.55 F |
| 4,185,181 | 1/1980 | Kaneko et al. | 219/10.55 F |
| 4,210,793 | 7/1980 | Fournet-Fayas | 219/10.55 F |
| 4,284,868 | 8/1981 | Simpson | 219/10.55 F |
| 4,316,069 | 2/1982 | Fitzmayer | 219/10.55 F |
| 4,324,967 | 4/1982 | Ikeda et al. | 219/10.55 F |
| 4,354,083 | 10/1982 | Staats | 219/10.55 F |

*Primary Examiner*—Roy N. Envall, Jr.
*Assistant Examiner*—M. M. Lateef
*Attorney, Agent, or Firm*—H. Neil Houser; Radford M. Reams

[57] ABSTRACT

A microwave oven with a dual feed excitation system comprising in one form of the invention a rotating antenna supported from the top cavity wall and a slotted radiating chamber supported from the bottom cavity wall. The antenna and radiating chamber are coupled to the magnetron output probe by a waveguide having a central section for receiving energy from the magnetron probe; a first section for coupling energy from the central section to the antenna and a second section for coupling energy from the central section to the radiating chamber. The fractional apportionment of the total energy from the magnetron between antenna and radiating chamber is a function of the impedance presented by each. The impedance of the antenna varies as the antenna rotates. The impedance of the chamber is particularly sensitive to food load parameters such as dielectric constant, which changes as the food cooks. Thus, the fractional distribution of energy between antenna and chamber varies during the cooking process, resulting in improved cooking performance.

12 Claims, 10 Drawing Figures

TOP

BOTTOM

MICROWAVE OVEN WITH DUAL FEED EXCITATION SYSTEM

BACKGROUND OF THE INVENTION

The present invention relates to a microwave cooking oven and specifically to an improvement thereof whereby uneven energy distribution within the oven cavity is modified for improved cooking performance.

In a conventional microwave oven cooking cavity the spatial distribution of the microwave energy tends to be non-uniform. As a result, hot spots and cold spots are produced at different locations. For many types of foods, unsatisfactory cooking results because some portions of the food may be completely cooked while others are barely warmed. The problem becomes more severe with foods of low thermal conductivity and low dielectric constant which do not readily absorb microwave energy or conduct heat from the areas which are heated by the microwave energy to those areas which are not. Foods such as cakes fall within this class. However, other foods frequently cooked in microwave ovens, such as meat, also produce unsatisfactory cooking results if the distribution of microwave energy within the oven cavity is not uniform.

One explanation for the non-uniform cooking pattern is that electromagnetic standing wave patterns, known as "modes," are set up within the cooking cavity. When a standing wave pattern is established, the intensities of the electric and magnetic fields vary greatly with position. The precise configuration of the standing wave or modal patterns is dependent at least upon the frequency of microwave energy used to excite the cavity and upon the dimensions of the cavity itself. Due to the relatively large number of theoretically possible modes, it is difficult to predict with certainty which of the modes will predominate. The situation is further complicated by the differing loading effects of different types and quantities of food and food containers which may be placed in the cooking cavity.

A number of different approaches to alter the standing wave patterns in the cavity have been tried in an effort to alleviate the problem of non-uniform microwave energy distribution. A common approach involves the use of a so-called "mode stirrer" which typically resembles a fan having metal blades. Normally, the mode stirrer is located in the vicinity of the waveguide oven cavity junction where the microwave energy is coupled from the waveguide into the cavity. The stirrer may be in the cooking cavity itself, in the waveguide near an exit port, or in a recess formed in one of the walls of the cavity, coupling the exit port from the waveguide with the cavity. Mode stirring is an attempt to randomize reflections by introducing time varying scattering of the microwave energy as it enters the cavity. The mode stirring approach provides some improvement to the non-uniform energy distribution problem, but such methods have not proven totally satisfactory. For example, it is still possible to have a region at one side of the cavity at a significantly higher strength than on the opposite side of the cavity. Uneven distribution can also occur in the front to back direction.

U.S. Pat. No. 4,133,997 shows a dual feed system in which energy is admitted to the cavity from waveguide exit ports on opposing side walls. A mode stirrer is located proximate to each exit port. This approach appears to be yet another modification of single feed mode stirrer arrangements, but is still short of being totally satisfactory for cooking foods.

Another approach to achieving more uniform cooking in the oven cavity is to employ a rotating table to support the food. The theory is that as the food is rotated through hot and cold spots in the oven, the time-averaged heating of the food will result in relatively uniform cooking. While somewhat effective, the results depend on the particular mode pattern established in the given oven and on the nature of the food to be cooked. For example, a vertically polarized predominantly TE mode will not perform satisfactorily in cooking horizontally-placed bacon strips despite the use of the rotating table. Also, a mode pattern that produces a low energy level in the center of the oven will cause the axial portion of the rotating food load to remain less well-cooked than the outer regions of the load which pass through the higher energy outer regions in the cavity, as the food rotates.

Yet another approach has involved the use of a rotating antenna in the cavity in an effort to achieve a more uniform heating pattern in the cavity. Prior art relating to such use of rotating antennas may be found in U.S. Pat. Nos. 4,028,521 to Uyeda et al, 4,284,868 to Simpson, and 4,316,069 to Fitzmayer, for example. Even though rotating antennas by themselves read to improve uniformity of energy distribution in the cavity, typical antenna configurations tend to leave cold spots. For centrally mounted antennas, such cold spots tend to occur near the center of rotation of the antenna. Additionally, the portion of the food load facing the antenna tends to cook more than the opposite side of the load, requiring turning of some foods for proper cooking. Thus, while the rotating beam antenna approach provides an improvement over the earlier mode stirrer arrangement, the food cooking performance is still not totally satisfactory.

The use of slotted feed arrangements in microwave ovens is also known in the prior art. Examples include U.S. Pat. Nos. 4,019,009 to Kusonoki et al; 2,704,802 to Blass et al; and 3,810,248 to Risman et al. Slotted feed arrangements of the Kusonoki type use surface wave phenomena for near field heating. Such arrangements tend to primarily heat the portion of the load nearest the slots and thus work well for relatively thin flat loads. For other types of loads, however, the surface waves are supplemented by energy radiated into the cavity from the top or side. Slotted feed arrangements, such as that of Blass et al and Risman et al tend to create standing waves with resultant cold spots at the nodes of the standing wave.

An example of a dual feed system using slots as radiators may be found in U.S. Pat. No. 3,210,511 to Peter H. Smith. The Smith arrangement provides single diametrically opposed slots on the top and bottom walls of the cavity oriented at right angles to each other. Radiation from the slots is 90° out of phase to produce circularly polarized radiation in the cavity. Commonly-assigned, U.S. Pat. No. 4,354,083 of Staats, provides yet another example of a dual feed system using slotted radiators for microwave ovens. The Staats oven employs arrays of slots adjacent the top and bottom cavity walls with a shelf immediately above the bottom slots to heat food supported on the shelf by use of near field heating effects. The top slots radiate microwave energy to illuminate the top portion of the food load.

While the various approaches to the problem of non-uniform energy distribution in microwave oven cavities summarized hereinbefore have achieved varying degrees of success in improving cooking performance, none has proven totally satisfactory in terms of cooking performance and convenience of use.

It is therefore an object of the present invention to provide a microwave oven having an excitation system which provides improved uniformity of time-averaged energy distribution in the oven cavity to more effectively cook even those foods having low thermal conductivity properties, which heretofore have been difficult to cook satisfactorily.

It is a further object of the present invention to provide a microwave oven of the foregoing type which eliminates, or nearly so, the need for manipulating the food load in the cavity during the cooking process.

SUMMARY OF THE INVENTION

In order to accomplish the objectives noted above, the present invention utilizes the advantages of both a rotating antenna and a slotted feed arrangement in a single microwave oven cavity which interact so as to improve the efficiency and uniformity of heating within the cavity for various types and shapes of food normally cooked or heated therein.

To this end, there is provided a microwave cooking cavity of the resonant type, the cavity comprising a generally cubic enclosure defined by conductive walls. The microwave excitation system for the cavity includes a dual feed system comprising dynamic microwave energy radiating means supported from one cavity wall, preferably the top wall, and static microwave radiating means supported from another wall, preferably the bottom wall. Waveguide means couples energy from a common micr vave energy source to the dynamic and static radiating means with the fraction of total energy provided to each radiating means being determined by the impedance load presented by each. The impedance of the dynamic radiating means varies with time and with the impedance of the food load being heated in the cavity. Additionally, the impedance presented by the static radiating means is a function of the food load being heated in the cavity. The food load impedance varies as the cooking process progresses. Consequently, the fractional distribution of energy from the energy source between dynamic and static feed means varies during the cooking process. This variation is believed to be a significant factor in the improved cooking performance demonstrated by the microwave oven of the present invention.

In accordance with one form of the invention, the dynamic field radiating means comprises a rotating antenna mounted to the top wall of the cavity. The static field radiating means comprises a hollow radiating chamber centrally extending along the bottom cavity wall having an array of radiating slots formed along the top face of the radiating chamber; the slots being arranged to establish a substantially stationary radiation pattern in the cavity which complements the average radiation pattern of the antenna by filling in those portions of the antenna pattern of relatively low energy density. In this arrangement, the antenna and radiating chamber are fed from a common energy source. The impedance of the antenna load is a function of both the angular orientation of the antenna in the cavity and the food load, and thus necessarily varies as antenna rotates. The proportion of total energy delivered to the radiating chamber fluctuates as the antenna load impedance fluctuates, causing the intensity of the output of the radiating chamber slots to fluctuate accordingly. Also, as the food load is heated, its dielectric constant gradually changes, causing the impedance of both the antenna and the radiating chamber and consequently the proportion of energy delivered to the radiating chamber to change accordingly. Thus, the proportion of total energy delivered to the antenna and radiating chamber fluctuates relatively rapidly about an average or nominal value in response to antenna rotation. This average value changes gradually as the cooking process progresses in response to changes in the dielectric constant of the food load. Thus, the interaction of the dynamic rotating antenna and the static radiating chamber provides a more uniform energy distribution throughout the cavity when time averaged over the cooking period. This results in significantly improved cooking performance.

BRIEF DESCRIPTION OF THE DRAWINGS

While the novel features of the invention are set forth with particularity in the appended claims, the invention both as to organization and content will be better understood and appreciated from the following detailed description taken in conjunction with the drawings in which:

DETAILED DESCRIPTION OF THE INVENTION

Figure 1:
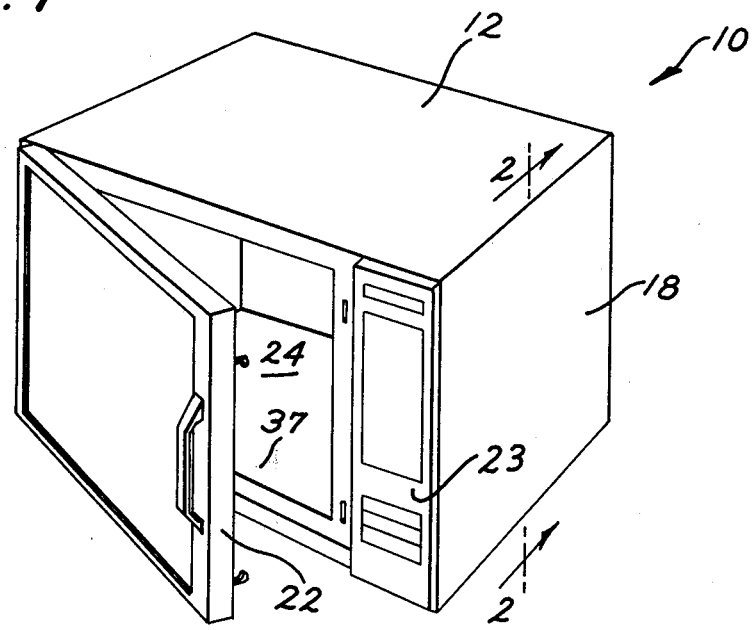
FIG. 1 is a front perspective view of a microwave oven.

Referring now to FIGS. 1–4, there is shown a microwave oven designated generally 10. The outer cabinet comprises six cabinet walls including upper and lower walls 12 and 14, a rear wall 16, two side walls 18 and 20, and a front wall partly formed by hingedly supported door 22 and partly by control panel 23. The space inside the outer cabinet is divided generally into a cooking cavity 24 and a controls compartment 26. The cooking cavity 24 includes a top wall 28, a bottom wall 30, side walls 32 and 34, the rear cavity wall being cabinet wall 16 and the front cavity wall being defined by the inner face 36 of door 22. Nominal dimensions of cavity 24 are 16" wide by 13.67" high by 13.38" deep. A support plate 37 of microwave pervious dielectric material such as that available commercially under the trademarks Pyroceram or Neoceram is disposed in cavity 24 substantially parallel to bottom cabinet wall 14. Plate 37 is supported from a support strip 38 which circumscribes cavity 24. Strip 38 is secured front to back along cavity side walls 32 and 34 and side to side from bottom wall 30 by expandable tabs 39 which project through small holes spaced along front and back edges of bottom wall 30 and side walls 32 and 34.

Controls compartment 26 has mounted therein a magnetron 40 which is adapted to produce microwave energy having a center frequency of approximately 2450 MHz at output probe 42 thereof when coupled to a suitable source of power (not shown) such as the 120 volt AC power supply typically available in domestic wall receptacles. In connection with the magnetron 40, a blower (not shown) provides cooling air flow for channelling air flow over the magnetron cooling fins 44. The front facing opening of the controls compartment 26 is enclosed by control panel 23. It will be understood that numerous other components are required in a complete microwave oven but for clarity of illustration and description only those elements believed essential for a proper understanding of the present invention are shown and described. Such other elements may all be conventional and as such are well known to those skilled in the art.

The excitation system for oven 10 in accordance with the present invention is a dual feed system comprising dynamic microwave radiating means supported from one cavity wall, preferably the top wall, and static microwave radiating means supported from another wall, preferably the opposite wall. The static and dynamic radiating means are excited by energy from a common source of microwave energy which is coupled from the source to the radiating means by waveguide means including a central section which receives energy from the source, a first section which extends from the central section to the dynamic radiating means and a second section which extends from the central section to the static radiating means. This junction of the first and second sections provides a means of impedance balance to control the energy into the first and second sections.

The term "dynamic radiating means" as used herein is defined as means having one or more radiating members which physically move relative to the cavity or the electrical equivalent thereof. Similarly, the term "static radiating means" refers to radiating members which are stationary relative to the cavity.

The energy delivered to the central waveguide section from the source is split between the first and second waveguide sections as a function of the impedance presented by each at the junction of each with the central section. The sending impedance presented to the magnetron by the dynamic radiating means at the entry port of the first section varies with time. The initial impedance presented by the static means at the entry port for the second section at the beginning of the cooking cycle is a function of the food load parameters, i.e., size, shape, dielectric constant, etc. In addition, as the food cooks certain parameters such as dielectric constant change, altering the impedances at both entry ports, but particularly at the entry port to the second section, as seen by the magnetron. The fractional apportionment of energy to the first and second sections varies as the impedances presented at their respective entry ports change, and thus adapts initially to the food load, and also changes as the food load characteristics change during the cooking process.

While it is believed that the improved cooking performance observed for the microwave oven herein described is in large part attributable to this varying fractional apportionment of energy between the dynamic and static radiating means, it will be understood that in view of the complexity of the interactions taking place in the cavity, precise causes of energy distribution patterns in the cavity are difficult to identify. The invention described and claimed herein should not be viewed as limited to a precise theory of operation, although every effort has been made to identify and explain its theory of operation for the benefit of workers in the art.

In the illustrative embodiment herein described, the dynamic radiating means takes the form of a rotating antenna designated generally 50 rotatably supported from top wall 28 of cavity 24. Static radiating means is provided in the form of a hollow slotted radiating chamber designated generally 52 which extends centrally along bottom wall 30 of cavity 24. The upper wall or face 55 of chamber 52 has an array of radiating slots 58 formed for radiating energy from within chamber 52 into cavity 24. Slots 58 are arranged to establish and support a substantially stationary radiating pattern configured to complement the radiating pattern of the rotating antenna by providing relatively high energy concentration in regions in which the energy from the antenna is relative low.

The source of microwave energy is magnetron 40. Microwave energy from magnetron output probe 42 of magnetron 40 is coupled to the dynamic and static radiating means 50 and 52, respectively, by waveguide means comprising a central section 62 which houses magnetron output probe 42, a first section 64 extending generally centrally along the upper cavity wall 28 to couple energy from probe 42 to antenna 50, and a second section 66 running in a vertical direction generally centrally along cavity side wall 32 to couple energy from probe 42 to chamber 52. A rounded step 78 formed at the junction of first and second sections 64 and 66, respectively, divides the power from magnetron 40 between these sections, matches the impedance of the system to the magnetron and facilitates excitation of the dynamic and static radiating means 50 and 52 in phase.

First waveguide section 64 is of generally rectangular cross section being jointly formed by member 68 of generally U-shaped cross section and top cavity wall 28. End wall 65 of section 64 provides a short circuit termination for section 64. Second waveguide section 66 is also of generally rectangular cross section being jointly formed by member 70 of U-shaped cross section and side wall 32. The end wall 71 of section 66 remote from magnetron 40 forms a standard 45° transition bend to guide energy propagated in section 66 through opening 72 which opens into radiating chamber 52. The 45° bend provides a low loss transition with no phase change or power dissipation. Members 68 and 70 are suitably flanged as at 74 and 75, respectively, for attachment to top wall 28 and side wall 32, respectively, by suitable means such as welding. Both sections are dimensioned to support a $TE_{10}$ propagating mode. Specifically, the width (the dimensions running front to rear of the cavity) is more than one-half but less than one guide wavelength and the height is less than one-half guide wavelength. In the illustrative embodiment, the height of sections 64 and 66 is nominally 0.75 inches and the width is nominally 3.66 inches.

Central waveguide section 62 is a generally rectangular enclosure which is formed on top and sides by an extension of member 68 beyond cavity 24 and on the bottom by support flange 76. Section 62 serves as a launching area for microwave energy radiated from magnetron probe 42 enclosed therein. Conductive end wall 77 spaced approximately ¾ inch from probe 42 provides a short circuit waveguide termination. The spacing is in accordance with magnetron manufacturer recommendation for proper power output and operating characteristics. Section 62 is of the same width as sections 64 and 66 but of significantly greater height (on the order of 2 inches), with an open end facing the rounded step 78 formed at the intersection of cavity side wall 32 and top wall 28. Step 78 serves to split the energy from section 62 between sections 64 and 66, in accordance with the impedance at the entrances of sections 64 and 66. Energy radiated from probe 42 in central section 62 propagates to the vicinity of step 78 where sections 64 and 66 join section 62. At this juncture the energy splits with a first portion propagating in first section 64 and a second portion propagating in second section 66, the fraction of the total energy apportioned to each being a function of the impedance presented to the magnetron at the entrance to each section.

It has been empirically determined that for most food loads satisfactory cooking performance for the dual feed system of the present invention is achieved when more power is radiated from the top than the bottom. Thus, in designing the excitation system those parameters bearing on the impedance presented at the entrance to each waveguide section, such as guide lengths, antenna parameters, and slot configurations, have been selected in accordance with standard design practices to provide impedance matching which results in the greater portion of the energy from the magnetron being coupled to antenna 50. Specifically, in the excitation system of the present invention these parameters are selected to provide high impedance at both points with the relative impedance being balanced to provide the nominal power split of 60–75 pecent of the total power going to section 64 for most loads.

The configuraton of the waveguide at the junction of sections 64 and 66 is significant. It is believed that the curved step at 78 (radius of curvature nominally 0.64") forms a junction which renders the sending impedance for both sections 64 and 66 more sensitive to antenna and food load impedance variations than would be the case with a more conventional bifurcator or power divider of the type projecting sharply into the junction region for power splitting.

Figure 2:
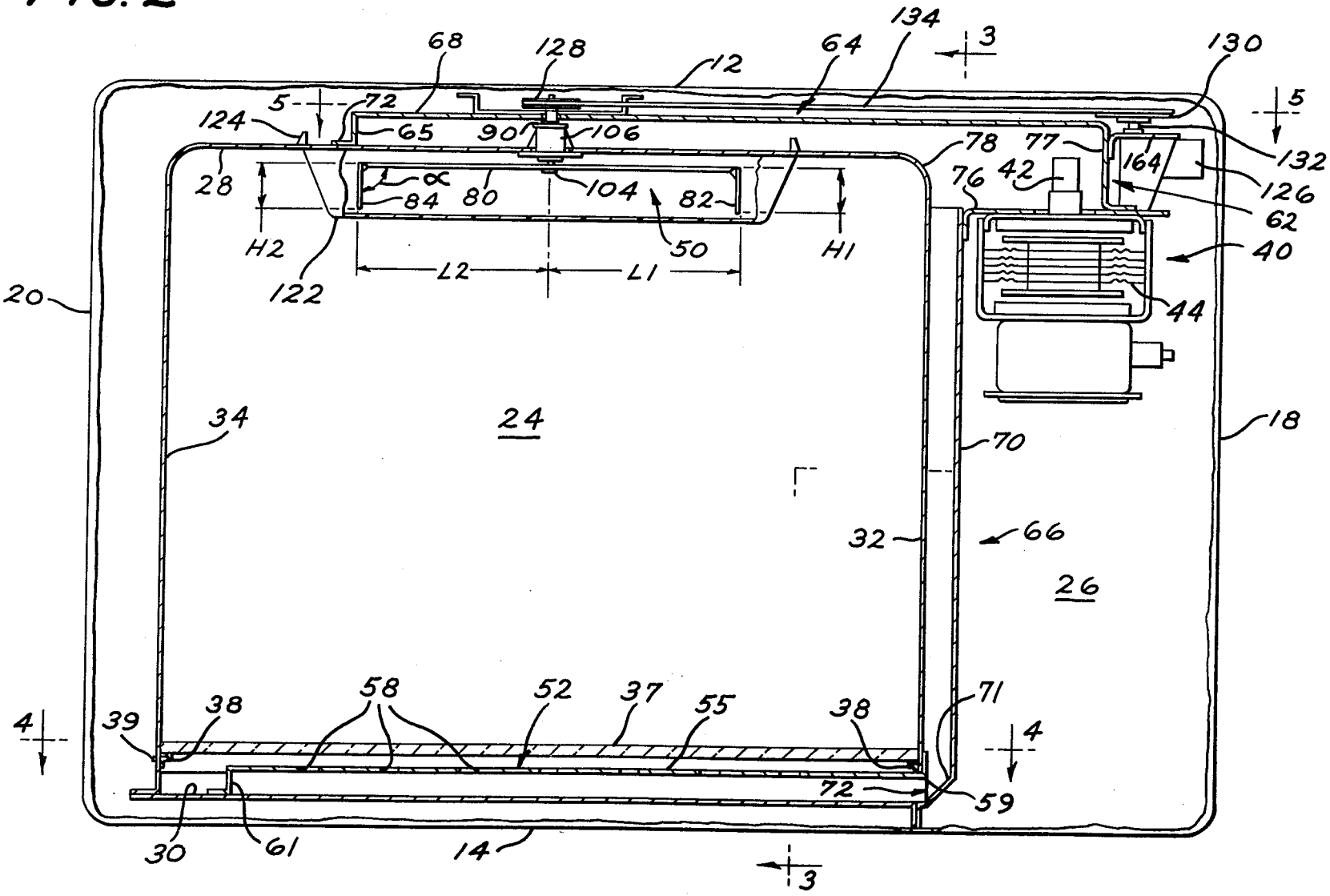
FIG. 2 is a front schematic sectional view of the microwave oven of FIG. 1 taken along lines 2—2.
Figure 3:
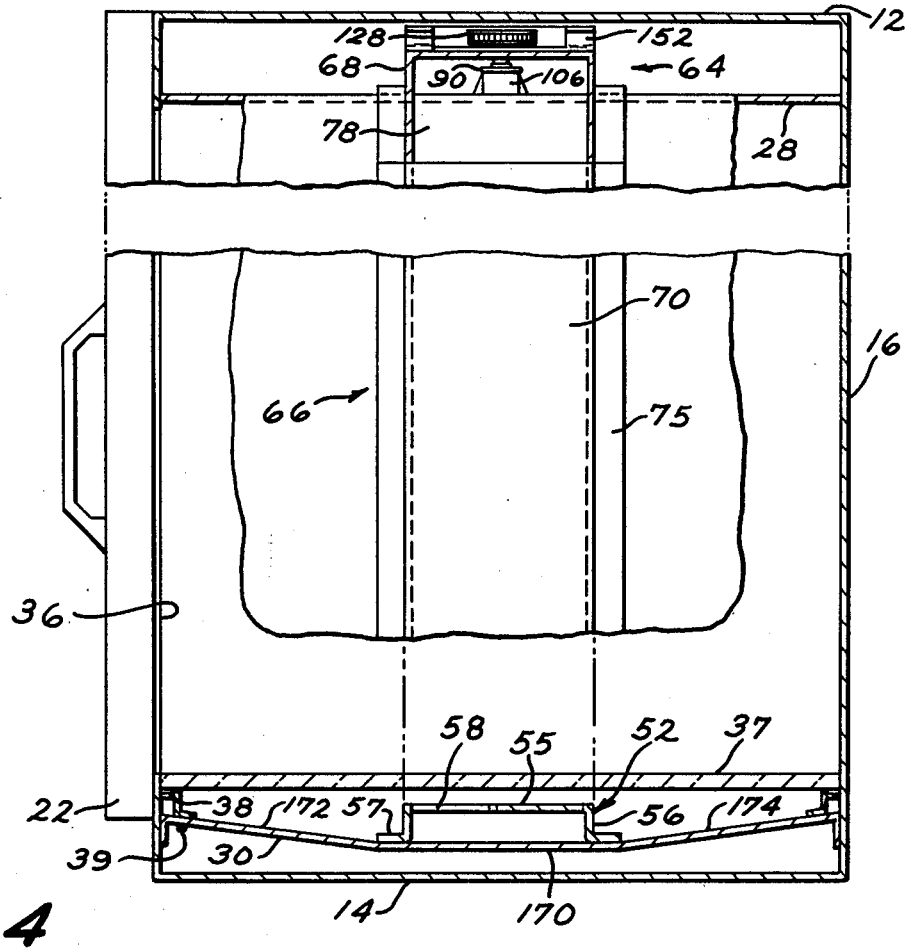
FIG. 3 is a schematic side view, partially in section, of the microwave oven of FIG. 1, with portions removed to illustrate details of the illustrative embodiment of applicant's invention.
Figure 5:
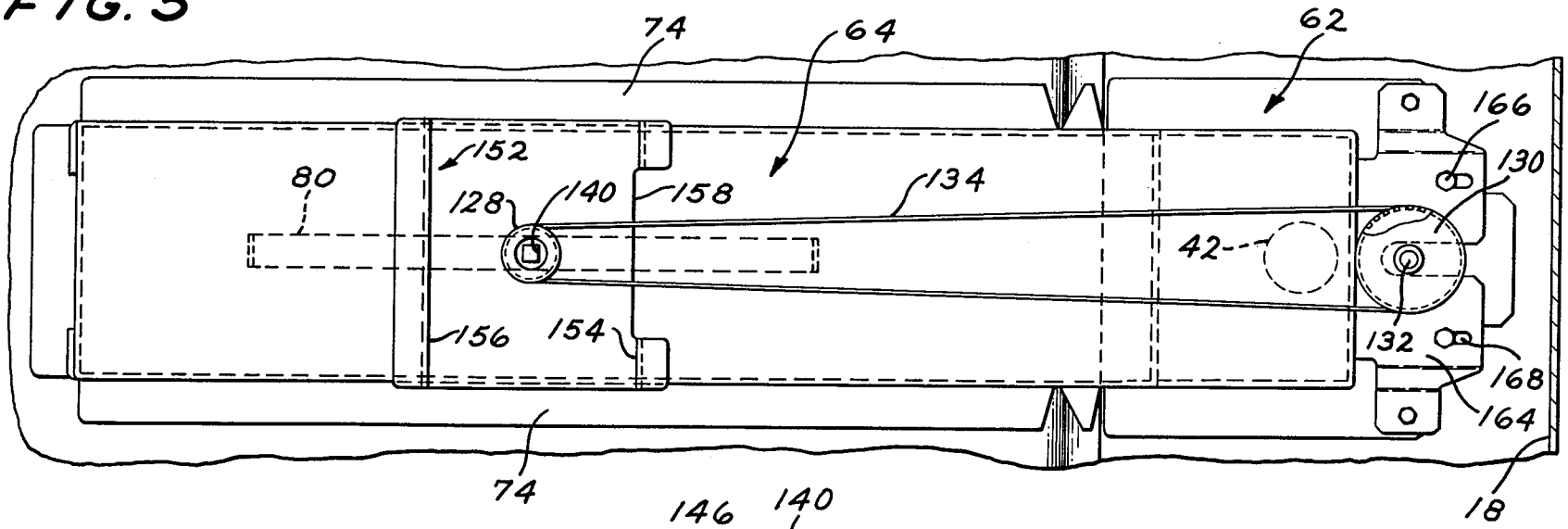
FIG. 5 is a partial enlarged top view of the oven of FIG. 1 taken along line 5—5 of FIG. 2 showing details of the drive system for rotating the antenna.

The antenna arrangement of the illustrative embodiment will now be described in detail with reference particularly to FIGS. 2, 5 and 6. The antenna designated generally 50 comprises a center fed microwave strip line member 80 extending substantially parallel to top cavity wall 28, vertically spaced from top wall 28 by a nominal distance of ¼ inch (approximately 0.05 free space wavelengths). Strip line member 80 is terminated at each end by vertical radiating members 82 and 84 which extend in a direction away from top wall 28 at an angle $\alpha$ to strip line 80 to provide predominantly TM mode excitation in the cavity. As the antenna rotates, it passes through positions of optimum coupling of certain modes supportable in the cavity. Because the antenna rotates, coupling with any one particular mode is momentary. However, efficiency of operation is believed to be enhanced if the antenna radiating members at least momentarily couple with anti-nodes of such modes. In the illustrative embodiment $\alpha$ is selected to be approximately 90°. However, this angle may be greater or less than 90° as necessary to provide the mode coupling desired for the particular cavity configuration.

Strip line member 80 and radiating members 82 and 84 are formed from a metallic strip preferably of approximately ½ inch (0.1 free space wavelengths) in width and approximately 0.025 inches (0.006 free space wavelengths) in thickness. Stripline member 80 is flanged along each edge for greater structural stiffness. The length of each of radiating members 82 and 84, designated H1 and H2, respectively, is nominally 1 inch (slightly less than one-quarter free space wavelength). Dimensions L1 and L2 are preferably selected equal so that the radiating members 82 and 84 are fed in time phase with each other. The length for L1 and L2 in the illustrative embodiment is chosen to be a nominal length of 4 inches (approximately ⅞ free space wavelengths) to provide the desired impedance match for radiating members 82 and 84.

Figure 6:
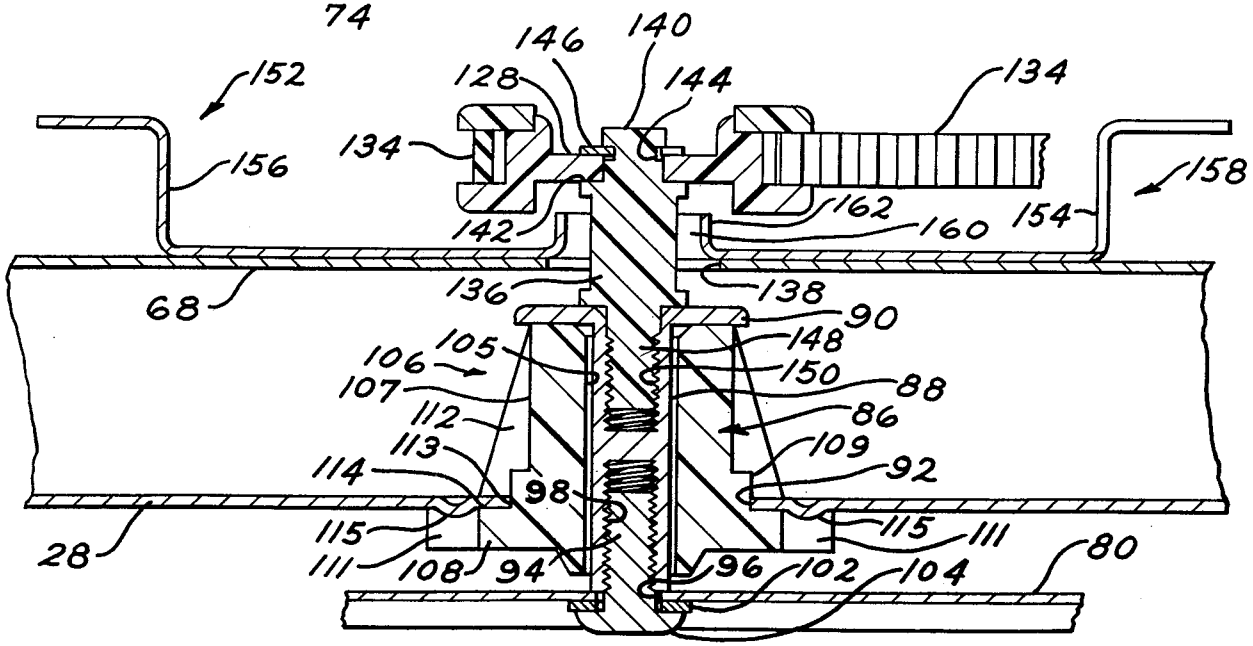
FIG. 6 is an enlarged schematic side sectional view of a portion of the oven of FIG. 1 showing details of the structure for supporting the antenna.

As best seen in FIG. 6, energy from waveguide section 84 is coupled to strip line member 80 by conductive metallic antenna probe designated generally 86. Antenna probe 86 comprises a cylindrical portion 88 terminating at one end in an impedance matching capacitive cap 90. The cap end 90 projects through aperture 92 formed in cavity wall 28 into the interior of waveguide section 64 for coupling therewith.

Probe 86 is located an integral multiple of 1/6 guide wavelengths from end wall 65 of guide section 64 for tight coupling in accordance with known design practice to contribute to the desired high sending impedance at the entrance to section 64. In the illustrative embodiment, aperture 92 is centered relative to cavity 24. End wall section 65 is extended a distance of 4/6 guide wavelengths beyond probe 86 to provide structural support to top cavity wall 28. The extent of penetration by probe 86 into guide section 64 is adjusted to provide the desired coupling. The maximum extent being limited by a requirement for sufficient clearance between cap section 90 and upper wall 68 of the guide section 64 to prevent arcing. In the illustrative embodiment, this gap is nominally set at 0.12 inches. The capacitive cap provides the desired equivalent electrical length for probe 86 for good impedance matching and coupling of energy from the waveguide.

Strip line member 80 is secured to probe member 86 by conductive metal screw 94 which passes through aperture 96 formed in strip line 80 and is received in threaded blind bore 98 formed in the end probe 86 opposite capacitive cap 90. A lock washer 102 sandwiched between head portion 104 of screw 94 and strip line 80 secures the strip line for rotation with probe 86.

Probe 86 is rotatably supported in aperture 92 in the top cavity wall 28 by a dielectric bushing 106. Aperture 92 is an opening of substantially square configuration. Dielectric bushing 106 includes a cylindrical shank portion 107 with an enlarged cylindrical portion 108 of diameter greater than the width of aperture 92. An intermediate portion 109 of diameter approximately equal to the width of aperture 92 is formed between portion 108 and shank portion 107. An axial bore 105 runs the length of bushing 106 for receiving probe 86. Enlarged portion 108 has formed therein a set of four radially extending longitudinal slots 111 (two of which are partially shown in FIG. 6) near the periphery thereof spaced at 90° intervals for mounting purposes. A set of four web members 112 (two of which are shown in FIG. 6) project radially from the periphery of shank 107. Web members 112 are aligned with slots 111 and extend axially substantially the entire length of shank portion 107. A set of four radially extending gaps 113 are provided between web members 112 and portion 108 of a width roughly equal to the thickness of cavity wall 28.

Bushing 106 is secured in position in aperture 92 as follows. Dielectric bushing 106 is first positioned in aperture 92 with the web members 112 oriented to bisect the corners of square aperture 92. When so oriented, there is sufficient clearance for the web members to permit insertion of bushing 106 into aperture 92. The dielectric bushing 106 is inserted through the aperture until shoulder 114, formed where portion 108 meets intermediate portion 109, is brought into engagement with wall 28. Bushing 106 is then rotated approximately 45° in either direction until dimples 115 formed in wall 28 are captured in radially extending slots 111 of portion 108. When so positioned dimples 115 prevent further rotation of bushing 106. In this manner the side walls 28 adjacent aperture 92 are captured in the radially extending gaps 113 formed between web members 108 and enlarged portion 108 to secure the dielectric member in position.

Probe 86 is rotatably received in bore 105. Supported in this fashion, probe member 86 extends into the interior of waveguide section 64 to couple energy propagating in waveguide section 64 from magnetron 40 to strip line member 80.

A microwave energy transparent antenna cover 122 (FIG. 2) of truncated conical configuration is provided to enclose antenna 50 to protect it from mechanical interference of items placed in cavity 24 and to keep it clean. Cover 122 is supported from cavity top wall 28 and secured thereto by tabs 124 projecting through holes in top wall 28.

Driving means for rotating antenna 50 in the illustrative embodiment is provided in the form of electric motor 126 drivingly coupled to antenna 50 by a pulley and belt arrangement which includes pulley 128 supported from antenna probe 86 and pulley 130 supported from drive shaft 132 of motor 126. Pulleys 128 and 130 are drivingly coupled by drive belt 134. An antenna drive shaft member 136 is supported on one end from antenna probe member 86. Shaft member 136 extends through aperture 138 in wall 68 of waveguide section 64 to carry antenna pulley 128. Both shaft member 136 and pulley 128 are formed of a dielectric material. Shaft end portion 140 of reduced square cross section extends axially from an annular shoulder 142. A slot 144 axially spaced from annular shoulder 142 circumscribes end portion 140. Pulley 128 is mounted to end portion 144 and secured thereto by C-ring 146 received in annular slot 144 which retains pulley 140 between C-ring 146 and annular shoulder 142.

The opposite end 148 of antenna shaft member 136, also of reduced cross section, is threaded for mechanical coupling with antenna probe member 86. A threaded blind bore 150 is formed in the annular flange end portion of probe member 86 for receiving threaded end portion 148 of antenna drive shaft 136.

An upwardly facing U-channel support member 152 extending transversely of waveguide section 64 is secured to the external face of top wall 68 of waveguide section 64 to prevent downward forces applied to the top wall 12 of the oven cabinet from interferring with pulley operation. Antenna drive pulley 128 is received in the channel between flanged side walls 154 and 156 of support member 152. A notch 158 is formed in side wall 154 to provide clearance for drive belt 134. A circular aperture 160 formed in member 152 ringed by an annular upwardly extending flange 162 is axially aligned with aperture 138 in the top wall 28 of cavity 24 to receive antenna drive shaft member 136. The aperture 160 and flange 162 are dimensioned to provide a choke seal to prevent leakage of microwave energy from waveguide 64 around shaft 136.

Drive motor 126 is supported by a motor mounting bracket 164. Mounting bracket 164 is suitably secured to the outer face of end wall 76 of central waveguide section 62 such as by welding. Electric motor 126 is in turn suitably secured to bracket 164 such as by mounting screws 166 received in slots 168 which permit tension adjustment for belt 134. Drive belt 134 which links pulleys 128 and 130 and the pulleys themselves are preferably toothed to prevent belt slippage. The motor speed and pulley diameter ratio is chosen to provide the desired rate of rotation of antenna 50. In the illustrative embodiment, satisfactory cooking performance has been achieved with a nominal rate of rotation of 120 rotations per minute.

While in the illustrative embodiment the rotating antenna is motor driven, it is to be understood that vanes could be provided along with proper ducting of the cooling air which would allow for air driven rotation of the antenna as well.

Referring now to the static microwave radiating means of the illustrative embodiment, rectangular radiating chamber 52 which extends centrally along the bottom wall of cavity 24 is formed by a channel member of generally U-shaped cross section having a top wall 55 and integral side walls 56. The U-shaped member is suitably secured to a flat central section 170 of the bottom wall 30 of the cooking cavity such as by welding. The side walls 56 have suitable flanges 57 to facilitate attachment to bottom wall 30 in a conventional manner, such as by welding. Open end portion 59 of chamber 52 joins waveguide section 66 of chamber 52 at opening 72 of waveguide section 66 to receive energy from waveguide section 66. Chamber 52 is terminated at its opposite end by wall 61 which provides a short circuit termination for chamber 52. The height and width dimensions of chamber 52 are chosen in the conventional manner hereinbefore described with reference to sections 64 and 66 of chamber 52 to support a $TE_{10}$ mode therein with the width being the same as those sections and the height being nominally 0.79 inches. Chamber 52 extends across a substantial portion of cavity 24 so as to provide the desired energy distribution pattern. However, the exact length thereof is chosen to provide the proper impedance imaged back to the entry port of waveguide section 66.

The top wall 55 of chamber 52 has formed therein an array of radiating slots 58 arranged to establish a particular substantially stationary radiation pattern in the cavity 24. Specifically, the slots are arranged to provide a radiating pattern which provides, at the cooking plane, regions of relatively high energy density which fill in areas of the antenna radiating pattern of relatively low energy density. The cooking plane is defined to be the region of cavity 24 adjacent the upper surface of support member 37.

Figure 7A:
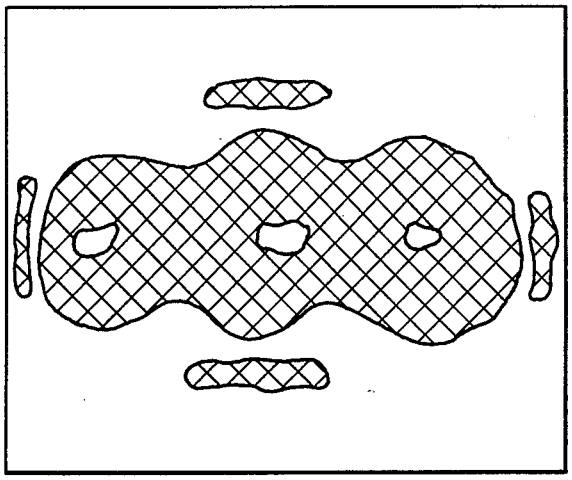
FIGS. 7A and 7B are sketches of the radiation patterns of the antenna and radiating chamber, respectively, of the microwave oven of FIG. 1 and the cooking plane of the oven.
Figure 7B:
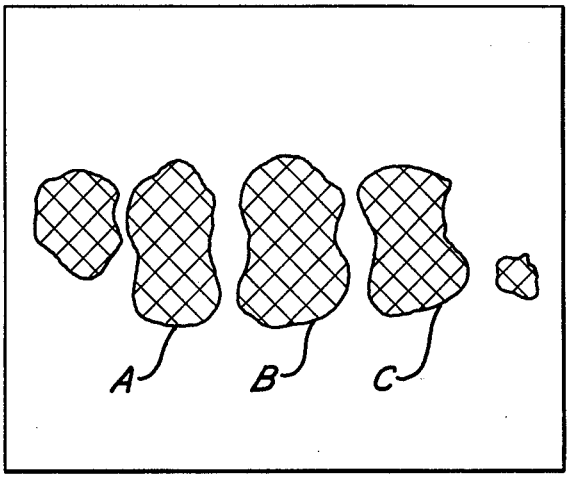

Before discussing the slot arrangement in greater detail, the basic radiating patterns of antenna 50 and slots 58 in the vicinity of the cooking plane in cavity 24 will be described with reference to FIGS. 7A and 7B. FIGS. 7A and 7B are sketches of energy distribution patterns for the oven of the illustrative embodiment observed by placing two sheets of heat sensitive material separated by an insulating medium approximately 0.25 inches thick on shelf 37 in cavity 24 for approximately 20 seconds with the oven operating at full power. FIG. 7A represents the energy distribution from antenna 50; FIG. 7B represents the energy distribution from chamber 52. The cross-hatched areas represent areas of relatively high energy density.

It is apparent from these sketches that the radiation pattern of the antenna has three regions of relatively low energy density aligned in a row extending side to side across the cavity, generally centrally front to back. Each of radiating slots 58 is constructed as a series slot; that is, the longitudinal axis of the slot is oriented crosswise to the direction of propagation in chamber 52. The configuration of the slot array is arranged to provide a substantially stationary radiating pattern having regions of relatively high energy density to fill in these relatively low energy density regions. As shown in FIG. 7B, the slots provide three major regions A, B and C of relatively high energy density which fill in the low energy regions of FIG. 7A.

Figure 4:
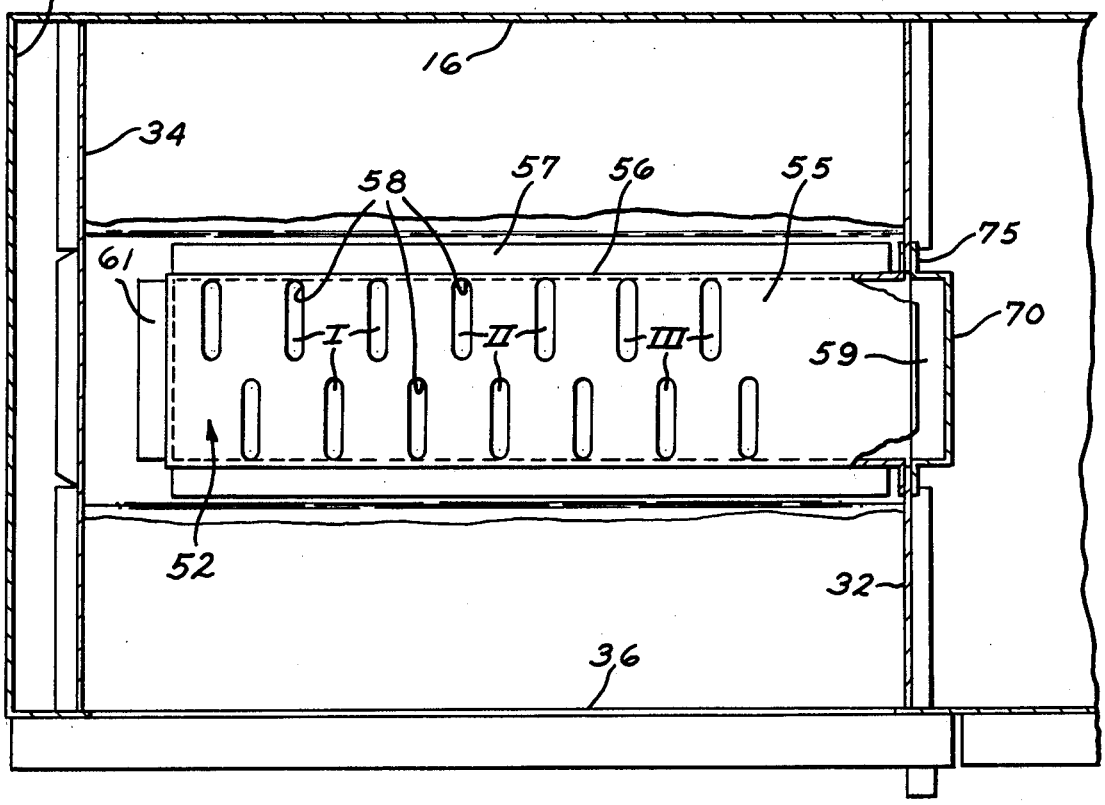
FIG. 4 is a schematic sectional view taken along line 4—4 of FIG. 2, with portions removed to show the details of the slots in the slotted feed chamber.

This pattern is created primarily by three groups of slots, designated I, II and III in FIG. 4. Slots within each group interact to provide the high energy density region associated with that group. Specifically, each of slot groups I, II and III is clustered around a maximum current point at a distance which is an approximate multiple of one half guide wavelength from end wall 61. Groups I, II and III provide the high intensity regions A, B and C, respectively, of FIG. 7B with the remaining slots making relatively minor contributions. The rows of slots are staggered to facilitate the constructive interference of adjacent slots.

The dimensions of the slots are chosen with a view to evenly distributing the energy along the radiating chamber and to provide the desired impedance matching. Specifically, slot lengths were chosen at substantially less than one-half a waveguide wavelength so as to provide non-resonant slots. This assures that energy is relatively evenly distributed along the length of chamber 52 rather than radiating primarily from those slots nearest the entrance to chamber 52.

While a particular slot configuration is described herein for illustrative purposes, it will be understood that other slot configurations, possibly including combinations of series and shunt slots, may be required to complement low energy regions for other antenna radiation patterns.

In addition to providing a radiating pattern which complements the antenna radiating pattern, the slotted bottom feed arrangement provides a degree of automatic adjustment of the fractional apportionment of power to the bottom radiating means to adapt the power output to the size of the load. It would of course be undesirable to provide the same amount of power from the bottom waveguide for food loads of both small and large lateral extant. If such were the case, either the large loads would tend to undercook or the small loads overcook. In the bottom slotted feed arrangement of the illustrative embodiment, those slots underlying the food load supported on shelf 37 are substantially tuned by the food load which is typically a relatively low impedance load for most foods. Those which do not underlie the food load are tuned by the relatively high impedance dielectric shelf 37. Thus, for food loads of relatively smaller lateral extent, less power is delivered to the bottom slots than for foods of substantial lateral extant which would tune all of the slots.

Also, the degree of tuning of slots to load is a function of the dielectric constant of the food load. Thus, this parameter also affects the sending impedance presented at the input port of section 66 and thus varies the proportion of power delivered to chamber 52.

As hereinbefore described, support plate 37 is disposed in cavity 24 for supporting food items to be heated in the cavity. Vertical spacing of plate 37 above chamber 52 is selected for desired impedance matching. This spacing significantly affects energy intensity at the bottom of food loads supported on plate 37. Different spacing may provide optimum results for different size loads. In the illustrative embodiment, a nominal spacing of approximately 0.18 inches was selected to provide satisfactory performance for a wide range of typical food load sizes. For loads of sufficient size to couple all of the slots, a greater spacing may provide optimum cooking performance; for smaller than normal loads, less separation may provide better performance.

The spacing which provides the desired impedance matching also enables support plate 37 to serve as a refracting member for the energy radiated from radiating chamber 52, as well as energy reflected from bottom cavity wall 30. The refracting function of plate 37 tends to laterally spread the energy radiation pattern radiated from slots 58 to more widely distribute this energy in cavity 24.

Bottom wall 30 of the oven cavity 24 has surfaces 172 and 174 which are bent or sloped upwardly from flat central section 170 to the front and rear walls, respectively, of the cavity. These surfaces operate primarily to reflect microwave energy from the antenna upwardly and centrally toward the food to be heated, which is usually located in the center portion of the oven. To this end the reflective surfaces are bent upwardly at an angle to the horizontal of between 3 and 14 degrees. The exact angle is chosen based on various parameters such as dielectric constant and typical foods to be cooked in the oven and its location in the oven cavity. In the illustrative embodiment, this angle is about 8 degrees to the horizontal.

While in the illustrative embodiment the angular reflected surfaces are provided in the bottom wall, it will be clear to those skilled in the art that such angle reflective surfaces could be located on other walls of the oven in an analogous manner. The overall result of redirecting energy impinging thereon from the interior of the cavity toward the central portions of the oven would take place.

The time varying impedance of the dynamic radiating means and the sensitivity of the impedance of the static radiating means to variations in dielectric constant of foods heated in the oven combine to significantly affect the operation and effectivness of the excitation system of microwave oven 10. This aspect of the invention will now be described with reference to FIGS. 8 and 9, considering first the effect of the time varying impedance of the dynamic radiating means.

Figure 8:
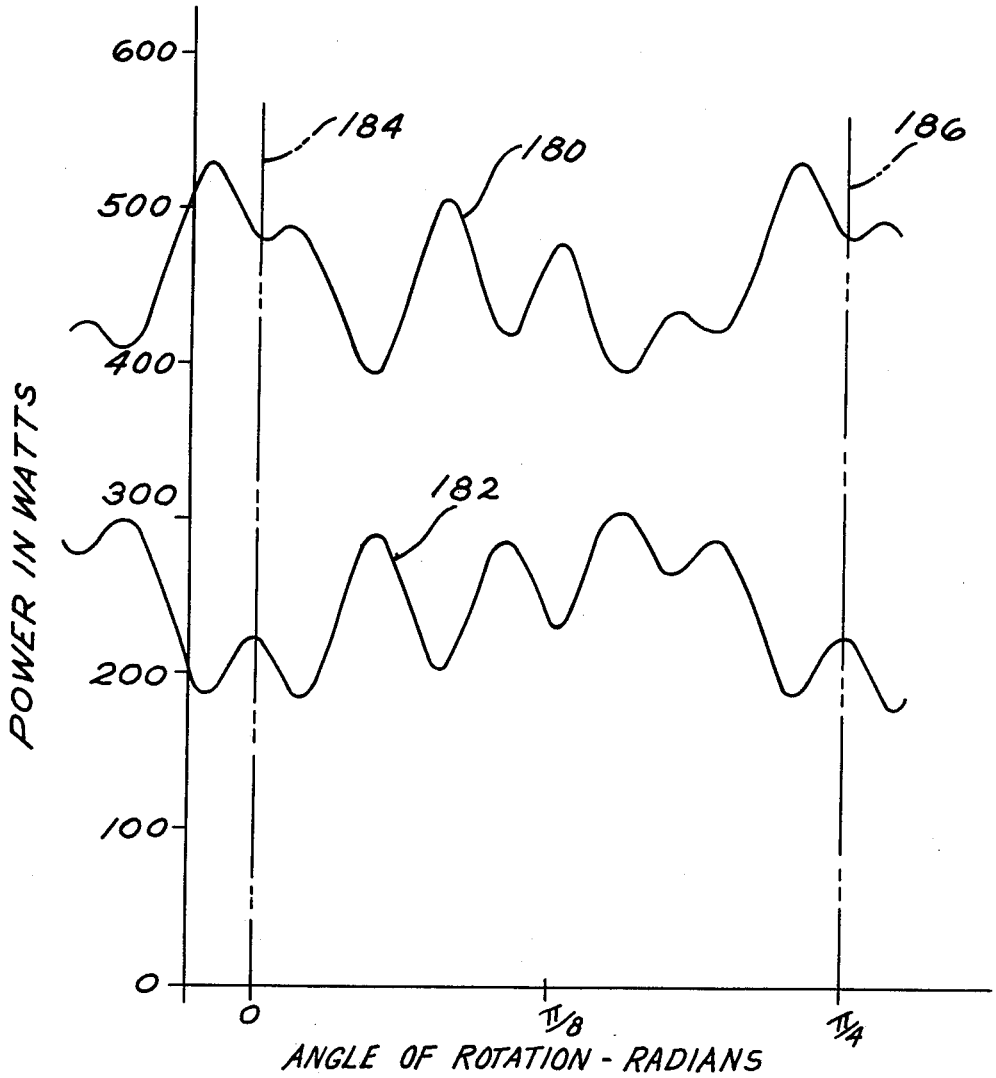
FIG. 8 is a graphical representation of output power as a function of time for the antenna and the radiating chamber of the oven of FIG. 1.

In the illustrative embodiment herein described, rotating antenna 50 serves as the dynamic radiating means. The impedance load presented by this antenna varies as the antenna rotates. This variation as a function of antenna position is believed due, at least in part, to the fact that as the antenna rotates the angles of reflection of energy radiated from the antenna which is reflected off the cavity walls vary. The resultant variation in energy reflected back to the antenna changes the impedance presented to the magnetron by the antenna load accordingly. Such variations are also believed due at least in part to variations in mode coupling as the position of the radiating members in the cavity varies. The graph of FIG. 8 shows the output power from antenna 50, represented by curve 180, and from the slotted radiating chamber 52 represented by curve 182 for a food load comprising a yellow sheet cake. This graph is a sketch of curves empirically obtained while rotating the antenna at a much slower rate (approximately 0.67 rotations per minute) than that employed for normal operation, for purposes of clearly demonstrating the phenomena. The portion of the curves between lines 184 and 186 represents a 45° rotation of antenna 50 (approximately 11 seconds). It is apparent from FIG. 8 that the output power from antenna and chamber each oscillate about a nominal average value as the antenna rotates. Stated another way, the fractional apportionment of energy between antenna and chamber fluctuates about a nominal average value. The oscillations are such that when the antenna output power is maximum the chamber output power is minimum and vice versa.

This shifting of power between the top and bottom radiators as the antenna rotates contributes to improved cooking performance by allowing the energy delivered to the food during peaks in the power curve either from top or bottom to spread through the food during the relaxation periods between peaks, thus reducing the likelihood of food overcooking at relative hot spots. While the precise reasons are not fully understood, in view of the significantly improved uniformity of cooking observed over systems in which such power fluctuations between top and bottom radiators do not occur, the power fluctuations are believed to be a significant contributing factor in the improved performance of the oven of the present invention.

Figure 9:
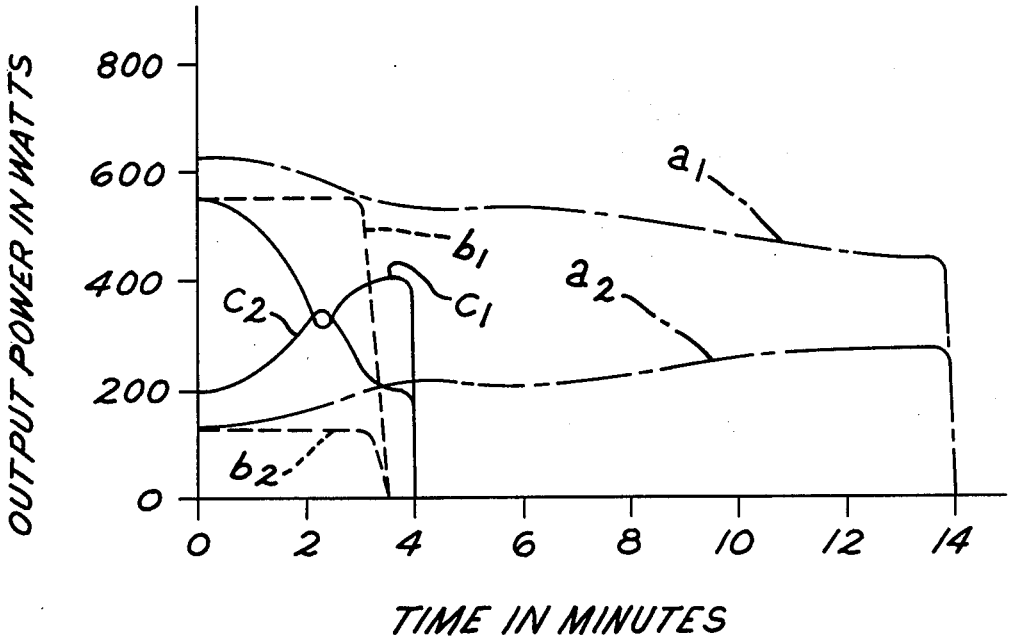
FIG. 9 is a family of curves representing the average output power of the antenna and radiating chamber of the microwave oven of FIG. 1 versus time for a variety of food loads.

Considering next the sensitivity of the power distribution to parameters of the food load, FIG. 9 is a family of curves representing the average output power of antenna and chamber over typical cooking periods for three representative food loads. The measurements from which these curves were derived were obtained through use of dual directional couplers mounted to the waveguide sections 64 and 66. The curves represent the net power (sum of forward and reverse power) delivered to each guide. It is to be understood that although the curves of FIG. 9 are shown as smooth curves, these curves represent the average output power, and that curves of actual output power would oscillate in the manner of the curves of FIG. 8; the frequency of the oscillations being primarily determined by the rate of rotation of the antenna.

Curves $a_1$ and $a_2$ represent the average antenna and chamber output power, respectively, for a moist sheet cake. Curves $a_1$ and $a_2$ tend to converge as the cooking cycle progresses, marking a gradual shift in the average fractional apportionment of energy between antenna and chamber over the cooking cycle. This gradual shift is believed primarily due to the change in the dielectric constant of the cake as it cooks. The resultant change in sending impedance for the chamber changes the impedance balance at the junction of guides 64 and 66, causing a greater portion of the total power from magnetron 40 to be delivered to the bottom waveguide. Curves $b_1$ and $b_2$ represent the output power curves for two sweet potatoes placed on shelf 37 over chamber 52. These curves remain relatively flat as the cycle progresses. Curves $c_1$ and $c_2$ represent the power of distribution for a load comprising four strips of bacon contained in a ceramic plate placed on platform 37. These curves which converge, cross, then diverge, demonstrate yet another form of response to impedance changes as the bacon cooks.

It is apparent from the foregoing that the gradual power shifting over the cooking period differs, and sometimes markedly so, for different types of food loads. However, it is believed that the gradual shifting of power in response to changing parameters of the food as it cooks, regardless of whether the bottom starts high and ends low, starts low and ends high, or oscillates as with bacon, results in greater uniformity of energy distribution in the oven cavity when averaged over the cooking period and thus contributes to the improved cooking performance of the microwave oven of the present invention.

The excitation system for oven 10 operates as follows. Energy from the magnetron 40 propagates from the central waveguide section 62 to waveguide sections 64 and 66. At the junction area where sections 64 and 66 join the central section 62, the energy is split with a portion propagating down each waveguide section. The microwave energy is fractionally apportioned between the waveguide sections as a function of the sending impedance presented at the junction area by each of waveguide sections 64 and 66, as hereinbefore described.

Microwave energy propagated along first waveguide section 64 to the antenna probe is coupled to the antenna strip line 80 by antenna probe 86, and propagates along the strip line member to the end radiating members 82 and 84. Energy is radiated from members 82 and 84 in conjunction with the energy pattern radiated from the slotted chamber 52. The beams from each of radiating members 82 and 84 illuminate the cavity as the antenna rotates to illuminate the food in the cavity primarily from the top; however, energy impinging on the side walls and angled bottom walls are reflected to impinge on the food from the sides and the bottom as well. As the antenna rotates, the orientation of the radiating members varies, causing momentary coupling of different TM modes in the cavity.

Microwave energy propagated along second waveguide section 66 enters chamber 52 and is radiated into cavity 24 from slots 58. The slot configuration causes the radiation from each of slots 58 to constructively interfere with the radiation from adjacent slots, the overall effect being to support a substantially stationary radiation pattern which is diffused laterally by the refractory effect of plate 37.

Since as antenna 50 rotates the percentage of the energy from magnetron 40 which propagates to chamber 52 varies. Though the radiation pattern from chamber 52 remains substantially stationary, the intensity of the radiation varies, as illustrated in FIG. 8. Thus, particular portions of the food being heated are subjected to radiated energy from the bottom of varying intensity.

The energy intensity from antenna and radiating chamber oscillates about first and second average values respectively with the first average value being greater than the second average value at the beginning of the cooking cycle. These average values may vary as the parameters of the food load change during cooking. These variations in energy intensity are believed to be a primary factor in the significant improvement in uniformity of cooking provided by the microwave oven illustratively described herein.

While a specific embodiment of the invention has been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A microwave cooking appliance comprising:

a cooking cavity for receiving objects to be heated, including a top wall, a bottom wall, a back wall, a pair of opposing side walls and a front wall defined by a front opening access door;

a support shelf disposed within said cavity for supporting objects to be heated therein, the plane of said shelf defining a cooking plane for said cavity;

a source of microwave energy;

dynamic microwave radiating means supported adjacent said top wall and extending within said cavity for radiating microwave energy into said cavity, said dynamic radiating means having a time-varying impedance and a time-averaged radiating pattern characterized at the cooking plane by regions of relatively high energy density and regions of relatively low energy density;

static microwave radiating means supported adjacent said bottom wall for radiating microwave energy into said cavity, said static radiating means supplying a substantially stationary radiating pattern characterized by regions of relatively high energy density and regions of relatively low energy density at the cooking plane, which regions overlay at least some of said regions of low and high energy density, respectively, of said time-averaged antenna pattern, thereby enhancing the time-averaged energy distribution at the cooking plane; and means for fractionally apportioning the energy from said source between said dynamic field radiating means and said static field radiating means as a function of the relative impedance of each.

2. A microwave cooking appliance in accordance with claim 1 wherein said dynamic electric field radiating means comprises an antenna rotatably supported adjacent said top wall and means for rotating said antenna.

3. A microwave oven in accordance with claims 1 or 2 wherein said static radiating means comprises a hollow rectangular chamber extending along the interior of said bottom wall of said cavity, said chamber having formed along the length thereof an array comprising a plurality of radiating slots for coupling energy from within said chamber into said cavity, said slots being arranged to establish and support said substantially stationary radiation pattern in said cavity.

4. A microwave cooking appliance comprising:

a cooking cavity for receiving objects to be heated, including a top wall, a bottom wall, a back wall, a pair of opposing side walls and a front wall defined by a front opening access door;

a source of microwave energy;

a support shelf for supporting objects to be heated in said cavity, the plane of said shelf defining the cooking plane in said cavity;

antenna means for radiating microwave energy into said cavity rotatably supported from said top wall having an impedance which varies as said antenna rotates;

means for rotating said antenna;

static microwave radiating means having an impedance which changes as dielectric constant of the object received in said cavity for heating changes;

waveguide means for fractionally apportioning energy from said source between said antenna and said static means as a function of their respective impedances such that as said antenna rotates its output power oscillates about a first average value and the output power of said static means oscillates about a second average value, the antenna output power being a relative maximum and relative minimum when the output power from said static means is a relative minimum and maximum, respectively; said first and second average values tending to change as the dielectric constant of the object to be heated supported on said shelf changes during cooking.

5. A microwave appliance in accordance with claim 4 wherein the said first average value is initially greater than said second average value.

6. A microwave appliance in accordance with claim 4 wherein said static means comprises a hollow rectangular chamber extending laterally across said bottom wall generally centrally thereof, said chamber having radiating slots formed along the length thereof for establishing a substantially stationary radiating pattern in said cavity.

7. A microwave oven in accordance with claim 6 wherein said antenna has a radiating pattern having certain regions of relatively low energy density at the cooking plane and said slots are arranged such that said stationary pattern provides regions of relatively high energy density at said cooking plane in at least certain ones of said low energy density regions of the radiating pattern of said antenna.

8. A microwave oven in accordance with claim 7 wherein the impedance of said chamber varies as a function of the number of said slots tuned by the object supported on said shelf.

9. A microwave oven in accordance with claim 8 wherein said antenna comprises a probe manner rotatably supported in an aperture in said top wall of said cavity; a center fed microwave stripline member supported from said probe member a predetermined distance from said top wall and extending substantially parallel to said top wall; a pair of radiating members terminating at opposite ends of said stripline member, each member extending at an angle relative to said stripline member for TM mode excitation of said cavity.

10. A microwave oven in accordance with claim 9 wherein said waveguide means comprises a central section for receiving energy from said source, a first section extending from said central section across said cavity to said aperture for coupling energy from said source to said antenna; and a second section extending downwardly along a side wall of said cavity for coupling energy from said source to said radiating chamber.

11. A microwave cooking appliance comprising:

a cooking cavity for receiving objects to be heated including a top wall, a bottom wall, a back wall, a pair of opposing side walls and a front wall defined by a front opening access door;

a support shelf disposed within said cavity for supporting objects to be heated therein, the plane of said shelf defining the cooking plane in said cavity;

a source of microwave energy;

dynamic radiating means comprising an antenna rotatably supported within said cavity adjacent said top wall for supporting a time-varying radiating pattern in said cavity, and means for rotating said antenna, said time-varying radiating pattern being characterized by a time-averaged radiating pattern having regions of relatively high energy density and regions of relatively low energy density at said cooking plane;

static radiating means comprising a radiating chamber disposed beneath said support shelf having a plurality of radiating slots formed along its length, said slots being arranged to provide a generally stationary pattern having regions of relatively high energy density and relatively low energy density at the cooking plane which are aligned with at least some of said low and high energy density regions, respectively, of said time-varying antenna radiating pattern at the cooking plane, thereby enhancing the time-averaged energy distribution at the cooking plane; and waveguide means comprising a central section for receiving microwave energy from said source and first and second branch sections extending from said central section to couple microwave energy from said source to said antenna and said chamber, respectively, the fractional distribution of energy between said antenna and said chamber varying as said antenna rotates.

12. A microwave cooking appliance in accordance with claim 11 wherein said antenna comprises a center fed microwave stripline member extending parallel to said top wall and terminated at each end by a radiating member extending at an angle away from said top wall for providing substantially TM mode excitation in said cavity, said radiating members being arranged to momentarily couple anti-nodes of certain TM modes supportable in said cavity as said antenna rotates.

* * * * *

UNITED STATES PATENT AND TRADEMARK OFFICE

CERTIFICATE OF CORRECTION

PATENT NO. : 4,458,126

DATED : July 3, 1984

INVENTOR(S) : Raymond L. Dills et al.

It is certified that error appears in the above-identified patent and that said Letters Patent is hereby corrected as shown below:

Column 16, line 52, "manner" should read -- member --.

Signed and Sealed this

*Twenty-third* Day of *October 1984*

[SEAL]

*Attest:*

GERALD J. MOSSINGHOFF

*Attesting Officer*

*Commissioner of Patents and Trademarks*